US005661877A

United States Patent [19]

Bloomer

[11] Patent Number: 5,661,877

[45] Date of Patent: Sep. 2, 1997

[54] BELT OR WEBBING BUCKLE HAVING PLURAL INDEPENDENTLY OPERABLE SECUREMENT AND RELEASE MECHANISMS

[76] Inventor: Ronald D. Bloomer, 7130 Cedarwood Cir., Boulder, Colo. 80301

[21] Appl. No.: 543,340

[22] Filed: Oct. 16, 1995

[51] Int. Cl.[6] ..... A44B 11/25

[52] U.S. Cl. ..... 24/170; 24/308; 24/309

[58] Field of Search ..... 24/170, 191, 193, 24/68 CD, 265 CD, 308, 309

[56] References Cited

U.S. PATENT DOCUMENTS

| | | | |
|---|---|---|---|
| 394,013 | 12/1888 | Rubin | 24/309 |
| 631,669 | 8/1899 | Rankin | 24/170 X |
| 1,490,199 | 4/1924 | Buchsbaum | 24/308 |
| 1,687,817 | 10/1928 | Wilson | 24/309 |
| 1,738,900 | 5/1929 | Henry | 24/309 |
| 1,989,153 | 1/1935 | Reiter | 24/309 |
| 2,926,408 | 3/1960 | Smith | 24/308 X |
| 2,941,272 | 6/1960 | Bourguignon . | |
| 3,201,840 | 8/1965 | Jantzen . | |
| 3,397,432 | 8/1968 | Banas . | |
| 3,593,388 | 7/1971 | Coyle . | |
| 3,608,158 | 9/1971 | Bengtsson | 24/170 |
| 3,795,028 | 3/1974 | Weiss | 24/191 X |
| 3,852,855 | 12/1974 | Bengtsson | 24/170 X |
| 4,631,784 | 12/1986 | Fildan | 24/170 |
| 4,675,956 | 6/1987 | Cohen . | |
| 4,726,625 | 2/1988 | Bougher | 24/170 X |
| 5,005,527 | 4/1991 | Hatfield | 24/170 X |
| 5,291,638 | 3/1994 | Huang | 24/191 X |
| 5,431,365 | 7/1995 | Hopkins | 24/170 X |

OTHER PUBLICATIONS

Trident Diving Equipment for All Your Diving Accessories; Underwater Diving, Inc.; 1994.

*Primary Examiner*—Peter M. Cuomo
*Assistant Examiner*—Stephen Vu
*Attorney, Agent, or Firm*—Harold A. Burdick

[57] ABSTRACT

A buckle for securement of one or more belts or webbings is shown, the buckle including a mount having first and second independently operable belt or webbing clamping members pivotably mounted thereon along a common axis over a belt receiving path defined across the mount.

17 Claims, 4 Drawing Sheets

BELT OR WEBBING BUCKLE HAVING PLURAL INDEPENDENTLY OPERABLE SECUREMENT AND RELEASE MECHANISMS

FIELD OF THE INVENTION

This invention relates to buckles for releasably securing ends of a belt or webbing, and, more particularly, relates to such buckles having multiple release mechanisms.

BACKGROUND OF THE INVENTION

Securement of belts or webbings, for safety related reasons, often calls for attention to prevention of accidental release of the securement. For example, divers' weight belt assemblies utilize a well known type of buckle which includes a single pivotable lever arm attached to a buckle body, the lever arm clamping the belt received at the buckle body to hold the belt thereat until release by the user. The buckle is necessarily of simple design in consideration of the manual dexterity often lost when diving due to a variety of physical factors.

However, such buckles are prone to accidental release by snagging or the like because only a single movement of the lever arm is required to release the buckle and thus the belt. Such unintended release causes an immediate increase in diver buoyancy due to loss of weight and thus can result in unexpected or increased rate of assent of the diver, a potentially dangerous and life threatening event.

A wide variety of securements for belts and webbings have been heretofore known and or utilized, some including buckles having a clamping-type arrangement (see, for example, U.S. Pat. No. 3,397,432). Such securements have included safety release buckles which, in association with a particularized structure fastened to an end of a belt or webbing, require movement of two release mechanisms to allow release of the particularized structure at the end of the belt or webbing from the buckle (see U.S. Pat. Nos. 3,201,840, 4,675,956, 2,941,272 and 3,593,388).

However, many such heretofore known buckles for belts or webbings have either not addressed the problem of accidental release, or have addressed the problem by complex and cumbersome means, most often requiring alteration or addition of particularized structure to the end of the belt or webbing to be secured. Moreover, such heretofore known means for addressing the problem of accidental belt or webbing release have usually required the user to maintain reasonably unencumbered manual dexterity to operate the buckle.

It has been found that a belt assembly having two belts can often be useful in some applications. In such a case, it would be more functionally economical to have a single buckle capable of holding all four ends of the belt or webbing and/or selectively releasing the ends. For example, a diver might need to utilize two weight bearing belts so that, in cases of controlled assent or the like, part of the weight could be dropped and part kept during different portions of a dive. A single buckle adapted for such purposes, or for application in other cases where independently releasable belts or webbings in an assembly is desired, could be utilized.

SUMMARY OF THE INVENTION

This invention provides a belt or webbing buckle having plural independently operable securement and release mechanisms that is designed to maintain ease of operation for use even where conditions of manual dexterity are less than ideal. The buckle is less prone to accidental release by snagging or the like than convention single release buckles, and requires no alteration or addition of particularized structure to the end of the belt or webbing to be secured for most single belt applications. The buckle is adaptable for securement of plural belts of a belt or webbing assembly, while yet maintaining the enhanced safety provided by reduction of likelihood of accidental release. The buckle is particularly well adapted for use with divers' weight belts or weight belt assemblies.

The buckle of this invention includes a mount having a path defined thereat for movement thereacross of the end portion of a belt or webbing, and first and second members each having a clamping face. Each of the members is pivotably connected with the mount with the clamping face adjacent to the path and pivotable between securing and releasing positions independent of one another so that the end portion of the belt or webbing is secured by clamping of the end portion of the belt or webbing between the path and the clamping face of either one of the first and second members when at the securing position.

The path of the mount is defined between first and second side walls and includes lacing structure defined thereat for receiving and holding a second end portion of the belt or webbing. The pivotable members are connected with the mount along a common axis between the side walls of the mount. Each of the members has a manipulable end and is connected between the manipulable end and the clamping face with the mount so that the clamping faces are over the path and the manipulable ends are adjacent to one another.

For use with plural belts or webbings, the first member is used for releasably clamping an end portion of the first belt or webbing and the second member is used for releasably clamping an end portion of the second belt or webbing. The mount includes a first means for holding an opposite end portion of the first belt or webbing and a second means cooperative with means at an opposite end portion of the second belt or webbing for quick release of the opposite end portion of the second belt or webbing from the mount.

It is therefore an object of this invention to provide an improved buckle for belts or webbings.

It is another object of this invention to provide an improved belt or webbing buckle having plural independently operable securement and release mechanisms.

It is another object of this invention to provide an improved buckle for divers' weight belts.

It is still another object of this invention to provide an improved belt or webbing buckle having plural independently operable securement and release mechanisms that is designed to maintain ease of operation for use even where conditions of manual dexterity are less than ideal, that is less prone to accidental release by snagging or the like than convention single release buckles, and that requires no alteration or addition of particularized structure to the end of the belt or webbing to be secured for most applications.

It is still another object of this invention to provide a buckle for releasably securing an end portion of at least a first belt or webbing which includes a mount having a path defined thereat for movement thereacross of the end portion of the belt or webbing, and first and second members each having a clamping face, each of the members pivotably connected with the mount with the clamping face adjacent to the path of the mount and pivotable between securing and releasing positions independent of one another so that the end portion of the belt or webbing is secured by clamping of the end portion of the belt or webbing between the path of the mount and the clamping face of either one of the first and second members when at the securing position.

It is yet another object of this invention to provide a buckle for releasably securing opposite end portions of first and second belts or webbings by independently releasably clamping end portions of the first and second belts or webbings at the buckle and providing first means for holding an opposite end portion of the first belt or webbing and second means cooperative with means at an opposite end portion of the second belt or webbing for quick release of the opposite end portion of the second belt or webbing from the buckle.

It is still another object of this invention to provide a buckle for securement and release of an end portion of at least a first belt or webbing that includes a mount having a path defined between first and second side walls for movement thereacross of the end portion of the belt or webbing, and plural independently operable members pivotably connected with the mount along a common axis between the side walls of the mount, each of the members pivotable between a securing position for clamping the end portion of the belt or webbing against the path of the mount and a releasing position.

It is yet another object of this invention to provide a buckle for a diver's weight belt assembly which includes a mount having a path defined thereat for movement thereacross of a first end portion of the weight belt assembly, the path having lacing structure defined thereat for receiving and holding a second end portion of the weight belt assembly, and first and second members each having a manipulable end and a clamping face, the first and second members pivotably connected between the manipulable ends and the clamping faces thereof with the mount so that the clamping faces are over the path and the manipulable ends are adjacent to one another, the manipulable ends being independently pivotable between belt securing and releasing positions.

With these and other objects in view, which will become apparent to one skilled in the art as the description proceeds, this invention resides in the novel construction, combination and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
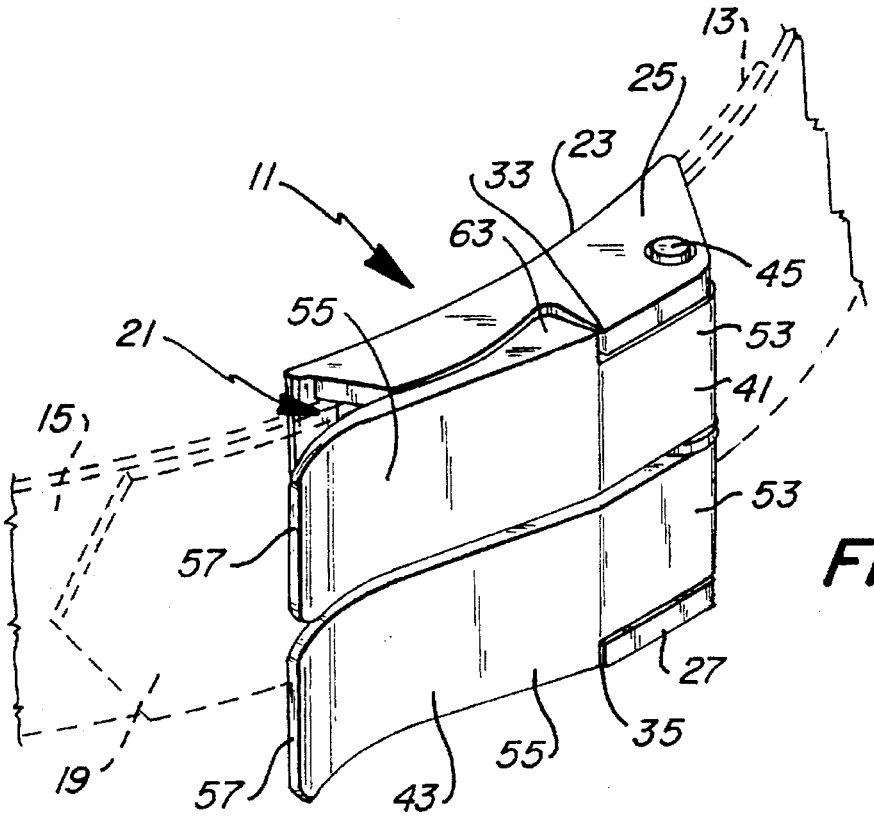
FIG. 1 is a perspective view of a first embodiment of the buckle of this invention.
Figure 2:
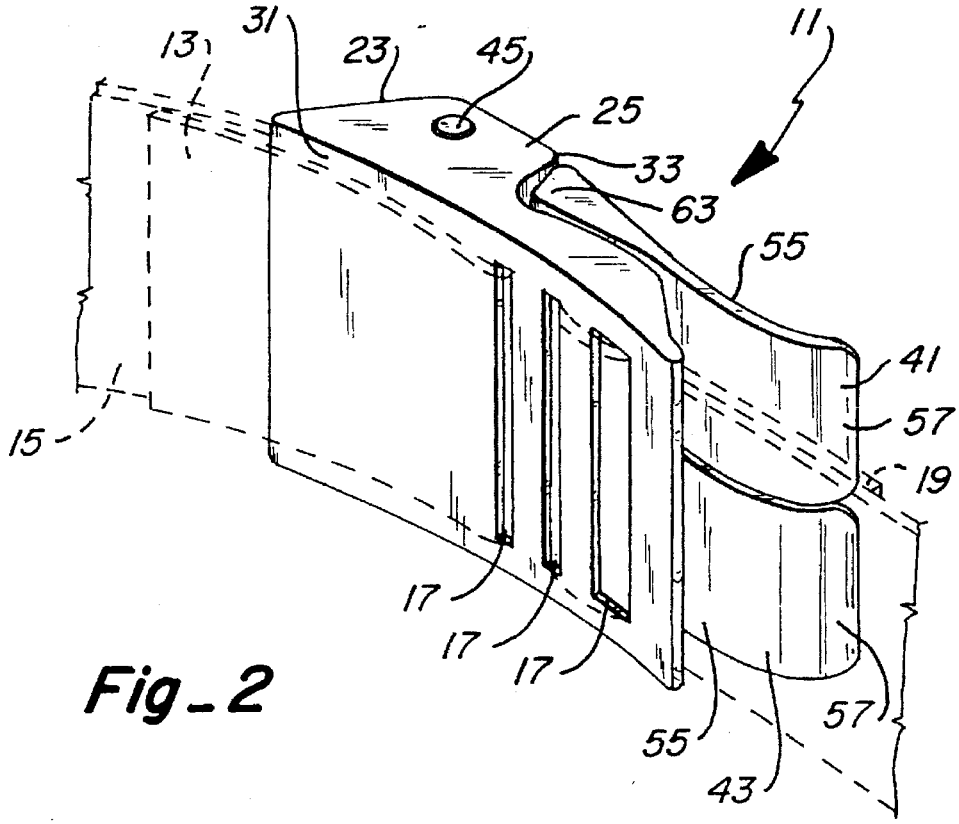
FIG. 2 is a reverse perspective view of the buckle of FIG. 1.
Figure 3:
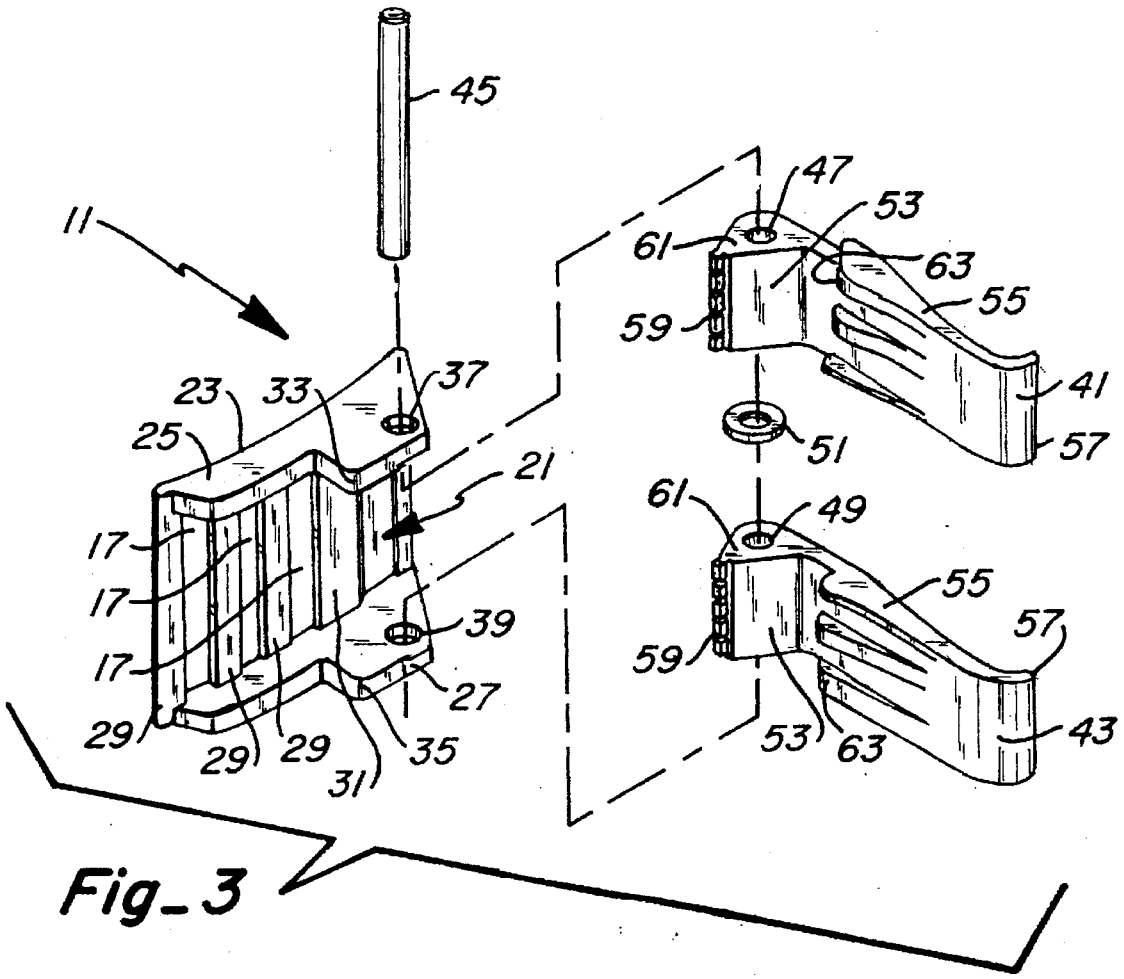
FIG. 3 is an exploded view of the buckle of FIG. 1.

The preferred embodiment of the buckle of this invention for use with a single belt or webbing is illustrated in FIGS. 1 through 3. Buckle 11 is engaged with one end 13 of belt or webbing 15 (for example, a diver's weight bearing belt of the type well known to those skilled in the diving arts) by threading end 13 through conventional lacing apertures 17 (other conventional means for holding end 13 on buckle 11 could be utilized, including more permanent engagements).

Opposite end 19 of belt 15 is receivable across path 21 of mount 23 defined between side walls 25 and 27 of the mount. The surface of path 21 is defined by dividing structures 29 adjacent to lacing apertures 17 and clamping surface 31. Each of walls 25 and 27 is contoured beginning at ridges 33 and 35, respectively, and includes a pivot mounting aperture 37 and 39, respectively (alternatively, pivot posts could be provided as would be apparent).

Independently operable clamping members 41 and 43 are pivotably mounted adjacent to one another along a common axis between walls 25 and 27 of mount 23 utilizing pivot pin 45 through apertures 47 and 49, respectively, of members 41 and 43 and apertures 37 and 39 in side walls 25 and 27, respectively (alternative arrangements for providing a pivot, as discussed in part above, could of course be utilized, including forming pivot pins on the members, or on one member and on the mount). In this manner, each of the members are pivotable in common directions to achieve belt or webbing securing and releasing positions. Washer 51 is mounted between members 41 and 43 over pivot pin 45 to provide a smooth rotational bearing surface for each of members 41 and 43.

Each of members 41 and 43 includes a pivot body 53 having a mounting aperture 47 or 49 thereat, a manually manipulable arm 55 extending from pivot body 53 to end 57, and clamping face 59 at end portion 61 extending at an angle (greater than about 90°) from pivot body 53 relative to arm 55. Each clamping face 59 is maintained over path 21 when the members are mounted, and is configured with a frictional surface (for example serrations). Each of the members 41 and 43 includes shoulder structure 63 which is movable into the contoured area of a related one of side walls 25 and 27 below ridges 33 and 35, respectively, the fit thereat, together with ridges 33 and/or 35, holding members 41 and 42 securely when moved to the belt or webbing securing position (as illustrated for both members in FIG. 1).

All parts of the buckle may be made of conventional materials (such as plastic or metal) utilizing known techniques (molding, milling or the like).

Figure 4A:
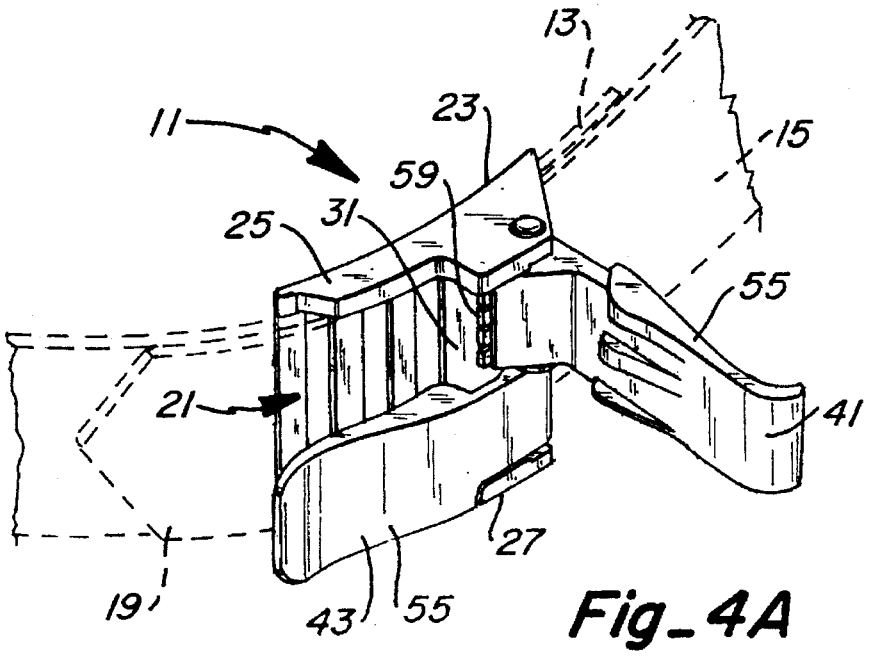
FIGS. 4A through 4C are perspective views of the buckle of FIG. 1 illustrating use of the buckle.
Figure 4B:
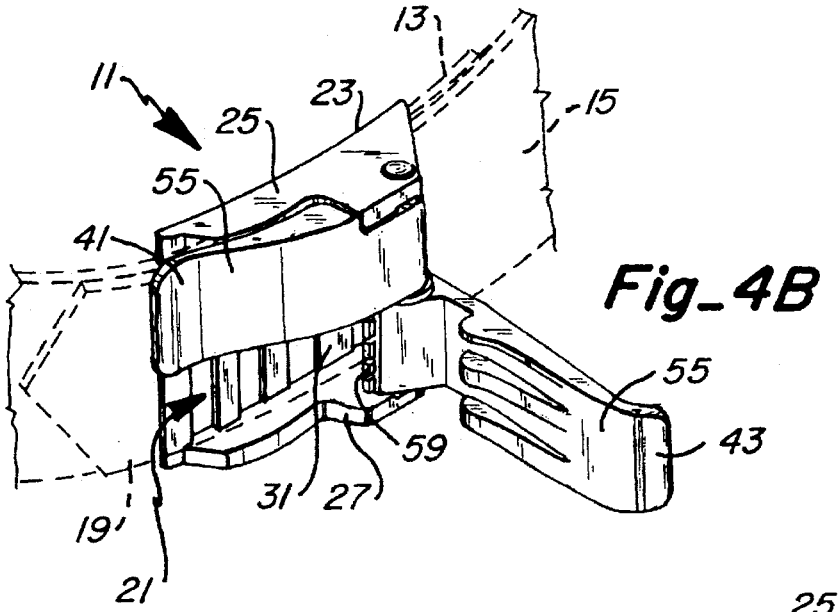
Figure 4C:
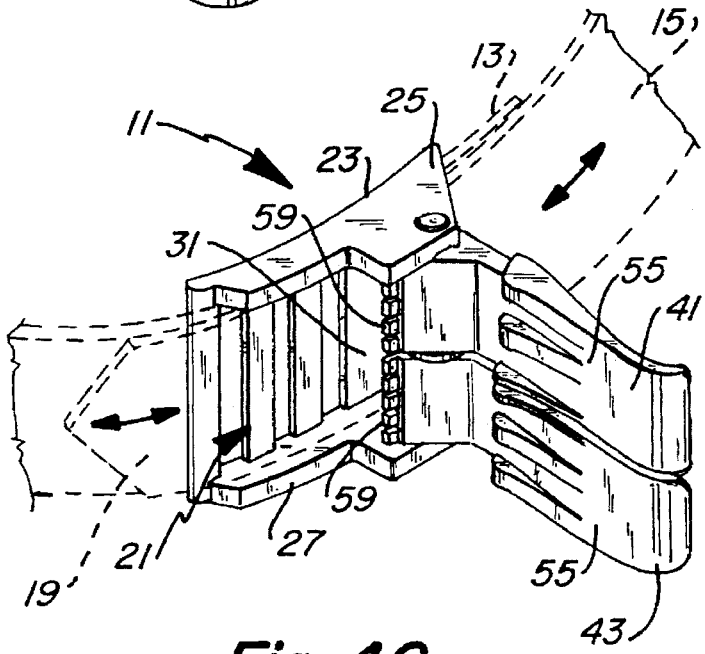

Turning now to FIGS. 4A through 4C, the advantageous use of the buckle of this invention is illustrated. FIGS. 4A and 4B illustrate that only one member (43 in FIG. 4A or 41 in FIG. 4B) needs to be in the securing position with end 19 of belt or webbing 15 clamped between a clamping face 59 and clamping surface 31 of path 21 for belt or webbing 15 to remain held by buckle 11. Thus, even if one or the other of members 41 or 43 are inadvertently moved to the releasing position with clamping face 59 spaced from path 21, the belt or webbing will not be accidentally released.

FIG. 4C illustrates that end 19 of belt or webbing 15 is only free to move (across path 21 and beneath clamping faces 59) when both members 41 and 43 are moved to the releasing position as illustrated.

Figure 5:
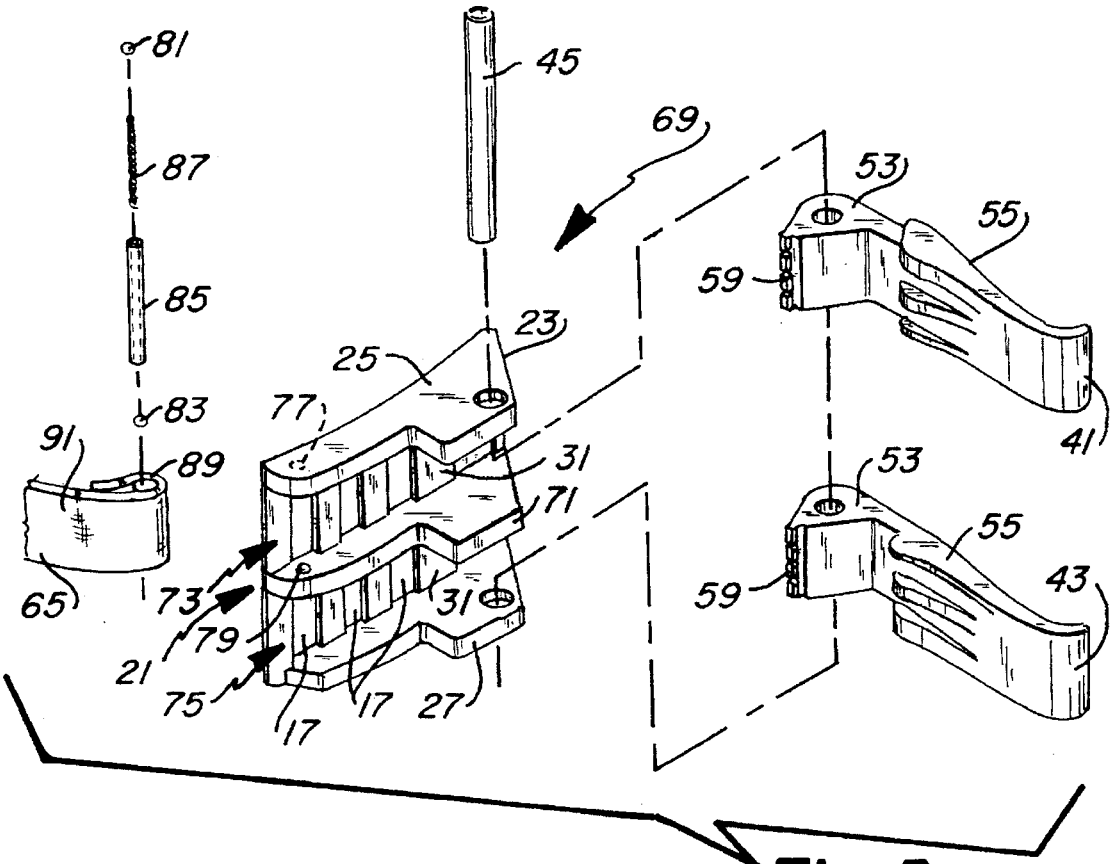
FIG. 5 is an exploded view of a second embodiment of the buckle of this invention.
Figure 6:
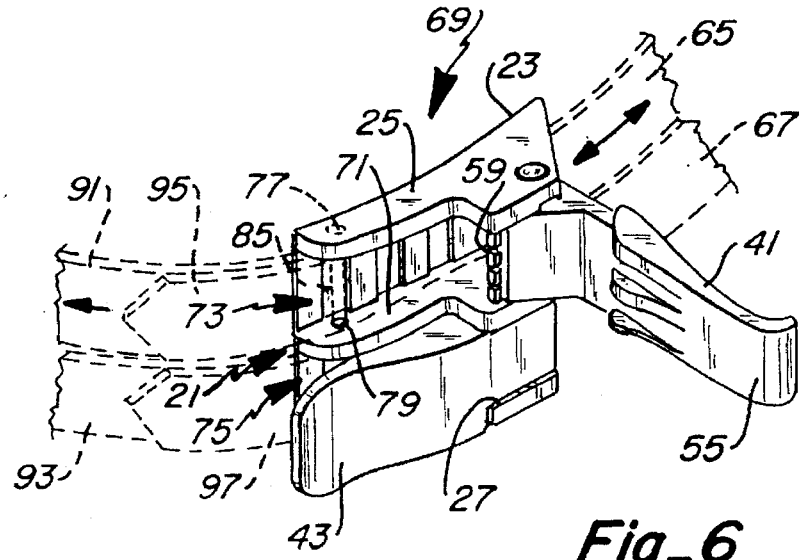
FIG. 6 is a perspective view of the buckle of FIG. 5 illustrating use of the buckle.

FIGS. 5 and 6 illustrate the preferred embodiment of the buckle of this invention for securement of plural belts 65 and 67 in a belt or webbing assembly, which may be used, for example, in a diver's weight bearing belt assembly. Buckle 69 is similar in many regards to buckle 11 described hereinabove, as is indicated by common identifying reference numerals. However, mount 23 includes dividing wall 71 along path 21 for dividing the path into first and second belt receiving tracks 73 and 75 for movement thereacross of different ones of belts 65 and 67, respectively, and thus obviating the need for washer 51.

In addition, detents 77 and 79 are bored in walls 25 and 71, respectively, for receipt therein of biased projections (balls (including rounded or conical projections), pins, or the like) 81 and 83 therein. As illustrated herein, biased projections 81 and 83 are held in tube 85 with spring 87 (having a spring force selected for the task as described hereinafter) therebetween, and the tube is maintained (by gluing, friction or the like) in sewn loop 89 of belt end 91 of belt 65. As may be appreciated, belt end 91 is thus held on buckle 69 utilizing this fairly common ball and detent type of structural relationship, and belt end 91 is readily pulled free from buckle 69 by a user giving a sharp tug on belt 65 (i.e., a quick-release type of arrangement).

The spring force of spring 87 must be selected to withstand normal usage without allowing movement of projections 81 and 83 from detents 77 and 79 (for example, when used with a weight bearing belt). Of course it should be recognized that the ball and detent structures could be reversed (with a detent arrangement at end 91 of belt 65 and biased projections at walls 25 and 71 of mount 23), and that types of structures other than those illustrated could be utilized to fulfill the function herein described (prefabricated ball plungers, small biased pistons, or the like). Moreover, the biased projection structure could be made to provide spring force adjustment, for example by dividing tube 85 in half and appropriately threading each adjacent end, with the threaded ends being joined by an adjustment nut for changing the spatial relationship between the threaded ends to thus change the potential energy of the spring.

When thus configured, end 93 of belt 67 is held in lacing apertures 17 as previously described, and ends 95 and 97 of belts 65 and 67, respectively, are releasably securable by members 41 and 43, respectively. When only one belt of the belt assembly is to be released, member 41 is moved to the releasing position (FIG. 6) and belt end 95 of belt 65 is removed from buckle 69. A sharp tug on belt 65 will then disengage the ball and detent structures (as set forth above) for release of belt 65 from the belt assembly.

If either member 41 or 43 is inadvertently moved to the releasing position, while belt 65 or 67 might be released from buckle 69, the belt will not be lost from the belt assembly, the affirmative action of pulling the belt free of the ball and detent structures being required in the case of belt 65, and belt 67 yet being held in lacing apertures 17.

As may be appreciated, this invention provides an improved belt or webbing buckle which requires plural activating movements to achieve release of a belt or belts held by the buckle.

What is claimed is:

1. A buckle for releasably securing an end portion of at least a first belt or webbing comprising:

a mount having first and second sides spaced from one another with a path defined therebetween and adapted for movement thereacross of the end portion of the belt or webbing; and first and second members each having a securement means, each of said members of a size selected to accommodate pivotable connection adjacent to one another between said spaced sides of said mount with said securement means of said first member positioned between said securement means of said second member and said first side of said mount and with said securement means of said second member positioned between said securement means of said first member and said second side of said mount, said securement means of said members being adjacent to said path of said mount and pivotable in the same direction between securing and releasing positions independent of one another, whereby said buckle is adapted so that the end portion of the belt or webbing is secured by holding the end portion of the belt or webbing at said path of said mount with said securement means of either one of said first and second members when at said securing position, but whereby said buckle is adapted to release the end portion of the belt or webbing from said buckle once secured only by movement of said securement means of both said first and second members to the releasing position.

2. The buckle of claim 1 wherein said first and second members each include a manipulable portion, each of said first and second members being pivotably connected with said mount between said securement means and said manipulable portion thereof.

3. The buckle of claim 1 wherein said path of said mount is defined between first and second sides, said first and second members being pivotably connected at said side walls.

4. The buckle of claim 1 wherein said mount includes means adapted for holding an opposite end portion of the belt or webbing.

5. The buckle of claim 1 further comprising a pivot means located relative to said mount and said first and second members to accommodate pivotable movement of said first and second members.

6. The buckle of claim 1 wherein said mount includes first and second side walls, said side walls providing a positive stop for said first and second members when at said securing positions.

7. A buckle for securement and release of an end portion of at least a first belt or webbing and an opposite end of the belt or webbing which is also held secure, said buckle comprising:

a mount having a path defined between first and second side walls and adapted for movement thereacross of the end portion of the belt or webbing, said mount including means adapted for holding the opposite end of the belt or webbing; and plural independently operable members pivotably connected with said mount along a common axis between said side walls of said mount with a first said member positioned between a second said member and said first side wall of said mount and with said second said second member positioned between said first securement means said members and said second side wall of said mount, each of said first and second said members pivotable in the same direction between a securing position adapted for clamping the end portion of the belt or webbing against said path of said mount and a releasing position adapted for unclamping and thus releasing the belt or webbing for movement relative to said buckle only when both of said members are moved to said releasing position.

8. The buckle of claim 7 wherein said first and second said members each include a clamping face having a friction surface.

9. The buckle of claim 7 wherein said first and second said members each include a pivot body having a manipulable end extending therefrom and a clamping end extending from said pivot body at an angle relative to said manipulable end.

10. The buckle of claim 9 wherein said side walls of said mount each include a ridge, and wherein said manipulable ends of said members each include a shoulder, said ridge and said shoulder cooperatively holding a related said first and second said members when at said securing position.

11. The buckle of claim 9 wherein said manipulable ends of said first and second said members are of a length sufficient to extend beyond said side walls of said mount when said first and second said members are at said securing position.

12. A buckle for a driver's weight belt assembly comprising:

a mount having a path defined thereat and adapted for movement thereacross of a first end portion of the weight belt assembly, the path having lacing structure defined thereat adapted for receiving and holding a second end portion of the weight belt assembly, said mount including first and second side walls, wherein said first side wall is one side of said path, and said second sidewall is opposite said path from said first side wall; and first and second members each having a manipulable end a clamping face, said first and second members pivotably connected between said manipulable ends and said clamping faces thereof with said mount so that said clamping faces are over said path and said manipulable ends are adjacent to one another, said manipulable ends being independently pivotable between belt securing and releasing positions with release of the weight belt assembly from said buckle occurring only when both of said manipulable ends of said first and second members are moved to said releasing position, each of said side walls of said mount providing a positive stop for each of said manipulable ends of said first and second members when at said securing positions.

13. The buckle of claim 12 wherein said first and second members are oriented at a pivotable connection with said mount so that said first and second members are pivotable in common directions between said securing and releasing positions.

14. The buckle of claim 12 wherein said first and second members are connected with said mount along a common axis of rotation.

15. The buckle of claim 12 further comprising pivot means located relative to said mount and said first and second members to accomodate pivotable movement of said first and second members.

16. The buckle of claim 12 wherein each of said first and second members includes a pivot body having said manipulable end extending therefrom with said clamping face extending from said pivot body at an angle relative to said manipulable end.

17. The buckle of claim 16 wherein said clamping faces of said first and second members include a frictional surface.

* * * * *